US008100111B2

(12) United States Patent
Stingele

(10) Patent No.: US 8,100,111 B2
(45) Date of Patent: Jan. 24, 2012

(54) FUEL INJECTION SYSTEM FOR AN INTERNAL COMBUSTION ENGINE

(75) Inventor: David Stingele, Gerlingen (DE)

(73) Assignee: Robert Bosch GmbH, Stuttgart (DE)

( * ) Notice: Subject to any disclaimer, the term of this patent is extended or adjusted under 35 U.S.C. 154(b) by 56 days.

(21) Appl. No.: 12/638,419

(22) Filed: Dec. 15, 2009

(65) Prior Publication Data

US 2010/0147268 A1 Jun. 17, 2010

(30) Foreign Application Priority Data

Dec. 17, 2008 (DE) ..... 10 2008 054 805

(51) Int. Cl.
*F02M 69/46* (2006.01)
*F02M 63/00* (2006.01)
*F02M 55/02* (2006.01)

(52) U.S. Cl. ..... 123/456; 123/447; 123/468

(58) Field of Classification Search ..... 123/456, 123/447, 468

See application file for complete search history.

(56) References Cited

U.S. PATENT DOCUMENTS

| | | | | |
|---|---|---|---|---|
| 5,056,489 | A * | 10/1991 | Lorraine | 123/468 |
| 5,511,527 | A * | 4/1996 | Lorraine et al. | 123/456 |
| 5,752,486 | A * | 5/1998 | Nakashima et al. | 123/467 |
| 5,884,607 | A * | 3/1999 | Schiller et al. | 123/467 |
| 5,954,031 | A * | 9/1999 | Ogiso et al. | 123/447 |
| 6,401,691 | B1 * | 6/2002 | Kawano et al. | 123/456 |
| 6,505,608 | B2 * | 1/2003 | Hiraku et al. | 123/458 |
| 6,601,564 | B2 * | 8/2003 | Davey | 123/456 |
| 6,807,944 | B2 * | 10/2004 | Mizuno et al. | 123/467 |
| 6,848,477 | B2 * | 2/2005 | Treusch et al. | 138/44 |
| 6,901,913 | B1 * | 6/2005 | Tsuchiya et al. | 123/456 |
| 6,935,314 | B2 * | 8/2005 | Zdroik et al. | 123/456 |
| 7,021,290 | B2 * | 4/2006 | Zdroik et al. | 123/456 |
| 7,040,290 | B2 * | 5/2006 | Kim | 123/456 |
| 7,146,965 | B1 * | 12/2006 | Li et al. | 123/456 |
| 7,647,917 | B2 * | 1/2010 | Matsuda | 123/447 |
| 7,827,962 | B2 * | 11/2010 | Weizenauer et al. | 123/456 |
| 2009/0159057 | A1 * | 6/2009 | Pursifull et al. | 123/575 |

FOREIGN PATENT DOCUMENTS

| | | | |
|---|---|---|---|
| DE | 102006003639 | A1 | 8/2007 |
| WO | WO 2007085313 | A1 * | 8/2007 |

* cited by examiner

*Primary Examiner* — Mahmoud Gimie
*Assistant Examiner* — David Hamaoui
(74) *Attorney, Agent, or Firm* — Ronald E. Greigg

(57) ABSTRACT

A fuel injection system of the common rail type for an internal combustion engine with two rows of cylinders is to be designed such that the deviations in the injection quantities of their injectors from one another are as slight as possible. The fuel injection system has a high-pressure pump, from which fuel flows to a first rail and a second rail which each have respective associated injectors for the two rows of cylinders. The first rail, in a structural unit with a throttle as a hydraulic connection, is preceded by a distributor block. From the distributor block, a connecting line leads to the second rail. The fuel injection system is preferably used in the automobile industry.

2 Claims, 1 Drawing Sheet

FUEL INJECTION SYSTEM FOR AN INTERNAL COMBUSTION ENGINE

CROSS-REFERENCE TO RELATED APPLICATION

This application is based on German Patent Application 10 2008 054 805.7 filed Dec. 17, 2008.

BACKGROUND OF THE INVENTION

1. Field of the Invention

The invention relates to a fuel injection system of the common rail type, with two separate rails for delivering high-pressure fuel to an internal combustion engine that has two rows of cylinders.

2. Description of the Prior Art

From German Patent Disclosure DE 10 2006 003 639 A1, a fuel injection system for a multicylinder internal combustion engine is known. This fuel injection system has a first and a second rail, and first injectors are disposed on the first rail and second injectors on the second rail, which injectors deliver the fuel to associated cylinders, one in each row of cylinders. A distributor block that is triggered by a high-pressure pump is integrated with one of the two rails.

OBJECT AND SUMMARY OF THE INVENTION

The object of the invention is to arrange the injection quantities of the fuel ejected from the injectors such that the deviations in injection quantities between the cylinders are as slight as possible.

The system according to the invention for injecting fuel has a first rail and a second rail, communicating with the first via a connecting line, as well as a high-pressure pump. The high-pressure pump furnishes fuel to a distributor block, which is integrated with the first rail, forming a diverter rail. The first and second rails have a number of connections of injector supply lines that corresponds to the number of cylinders of the engine. The volume of the diverter rail is composed of the volume of the distributor block and the volume of the first rail. The volume of the distributor block itself is the sum of the volumes of the connecting line and the second rail, minus the volume of the first rail, and multiplied by a factor that is in the range of 0.5 to 1. As a result, minimized deviations in ejection quantities of the injectors from one another are attained, along with optimized engine operation.

BRIEF DESCRIPTION OF THE DRAWING

The invention will be better understood and further objects and advantages thereof will become more apparent from the ensuing detailed description of a preferred embodiment taken in conjunction with the drawing.

DESCRIPTION OF THE PREFERRED EMBODIMENT

Figure 1:
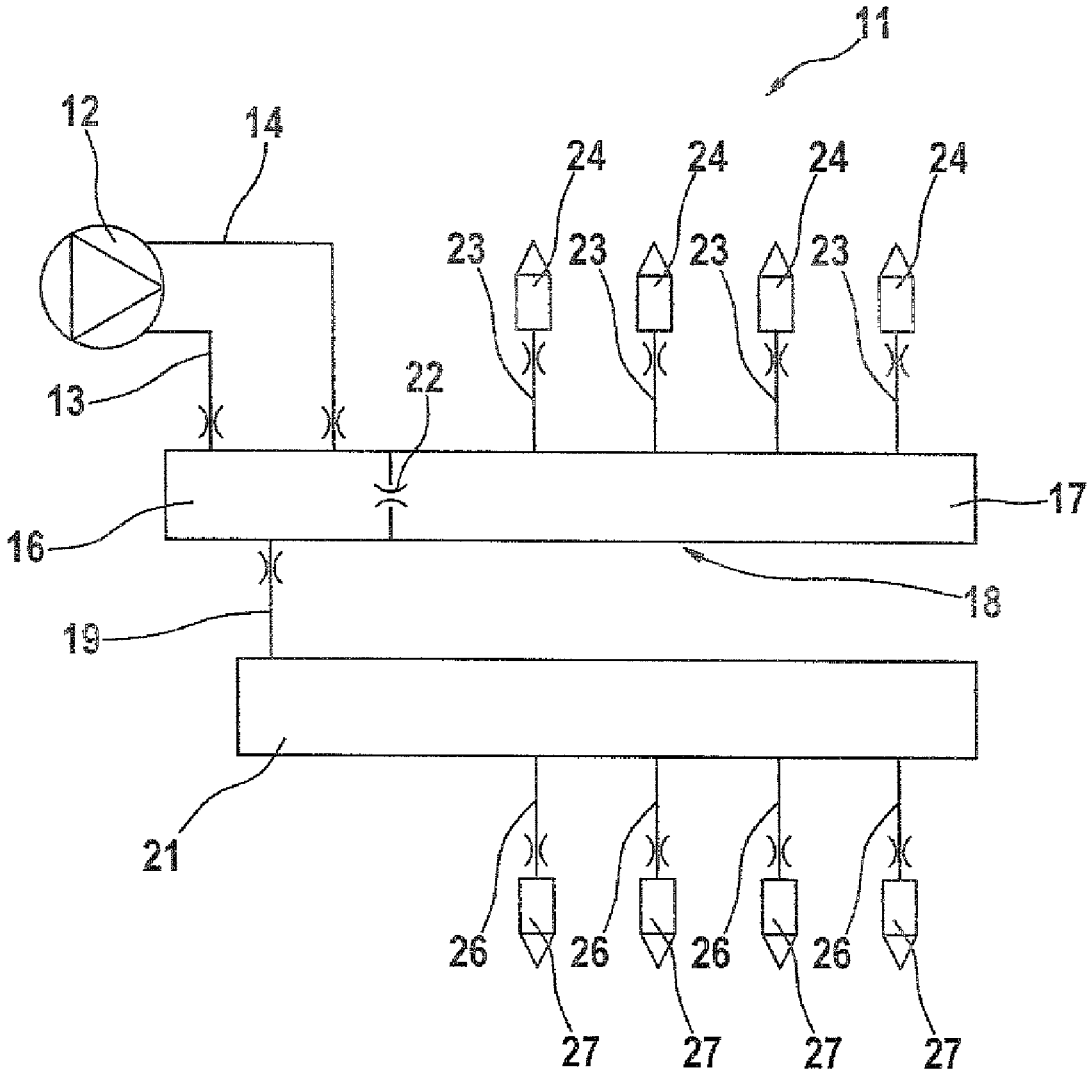
FIG. 1 shows the exemplary embodiment of the invention in schematic form as a block diagram.

A fuel injection system 11, shown in FIG. 1, for an internal combustion engine having two rows of cylinders has a high-pressure pump 12, which via a first delivery line 13 and a second delivery line 14 furnishes fuel to a distributor block 16. The distributor block 16, which is integrated with a first rail 17, forming a diverter rail 18, carries the fuel via a connecting line 19 to a second rail 21. Inside the diverter rail 18, the fuel is delivered from the distributor block 16 to the first rail 17, via a throttle restriction 22 hydraulically connecting these components, thus eliminating a further connecting line.

First injectors 24 are connected to the first rail 17 via first injector supply lines 23, and second injectors 27 are connected to the second rail 21 via second injector supply lines 26.

The first injectors 24 are associated with a first row of cylinders having four cylinders of the engine. Each of the first injectors 24 injects the fuel, collected at high pressure in the first rail 17, into respective cylinders in the first row of cylinders.

Correspondingly, the second injectors 27 are associated with a second row of cylinders having four cylinders. Each of the second injectors 27 injects the fuel, accumulated at high pressure in the second rail 21, into respective cylinders of the second row of cylinders.

In a manner not shown, the high-pressure pump 12 has two pistons, which in pulsating fashion dispense the fuel that is subjected to pressure. The attendant pressure fluctuations adversely affect a uniform ejection behavior between the individual first and second injectors 24, 27 of the fuel injection system 11.

Further pressure fluctuations occur because the injection from the injectors 24, 27 does not always take place in alternation from one of the injectors 24, 27 of the one rail 17, 21 to one of the injectors 24, 27 of the other rail 17, 21. The case also occurs in which two injectors 24, 27 of the one rail 17, 21 inject in succession before one of the injectors 24, 27 of the other rail 17, 21 again injects. The pressure drop, associated with an injection, in the affected rail 17, 21, in the above-described order of injections, leads to briefly extremely different fillings of the rails 17, 21, and when these are compensated for, pressure fluctuations necessarily occur.

In addition, because of the integration of the distributor block 16 with the first rail 17, forming the diverter rail 18, which desirably not only reduces the number of components and the installation space required but also reduces the costs for producing the fuel injection system 11, the design of the components of the fuel injection system 11 is asymmetrical. On the other hand, this asymmetry also undesirably promotes pressure fluctuations and differences in their transit times within the fuel injection system 11 along with attendant fluctuations in the ejection quantities of the injectors 24, 27.

With the embodiment according to the invention of the fuel injection system 11, these interfering factors are counteracted. The volume of the diverter rail 18 is composed of the volume of the distributor block 16 plus the volume of the first rail 17. The volume of the distributor block itself is the sum of the volumes of the connecting line 19 and of the second rail 21, minus the volume of the first rail 17 and multiplied by a factor that is in the range from 0.5 to 1. Within this range, in the embodiment of the diverter rail 18, it is possible to minimize the above-described influences of pressure fluctuations and of the asymmetry within the components of the fuel injection system 11 and the attendant differences in transit time through the connecting line 19, and to achieve an extensively symmetrical ejection characteristic of the fuel injection system 11. Thus it was possible for instance to attain an injection quantity accuracy of up to $\pm 0.5\ mm^3$, in contrast to what is otherwise an injection accuracy of $\pm 1.35\ mm^3$ in the case of a symmetrical embodiment of the components in a conventional fuel injection system.

The foregoing relates to a preferred exemplary embodiment of the invention, it being understood that other variants and embodiments thereof are possible within the spirit and scope of the invention, the latter being defined by the appended claim(s).

I claim:

1. A fuel injection system for an internal combustion engine of the common rail type, comprising:

a first rail and a second rail communicating with the first rail via a connecting line;

a distributor block that is integrated with the first rail, thereby forming a diverter rail;

a high-pressure pump, which furnishes the fuel to the distributor block; and the first rail and the second rail each having a number of connections of injector supply lines corresponding to a number of cylinders of the engine, wherein a volume of the diverter rail is in a range between 0.5 and 1 times the difference in volume between a total volume of the connecting line and of the second rail on the one hand, and a volume of the first rail on the other hand for the volume of the distributor block, plus the volume of the first rail, which in equation form is represented as $V_D=M(V_C+V_2-V_1)+V_1$, where: $V_D$=volume of diverter rail; $V_1$=volume of first rail; $V_2$=volume of second rail; $V_C$=volume of connecting line; and M=factor between 0.5 and 1.

2. A fuel injection system for an internal combustion engine of the common rail type, comprising:

a first rail and a second rail communicating with the first rail via a connecting line;

a distributor block that is integrated with the first rail, thereby forming a diverter rail;

a high-pressure pump, which furnishes the fuel to the distributor block; and the first rail and the second rail each having a number of connections of injector supply lines corresponding to a number of cylinders of the engine, wherein a volume of the distributor block itself is a sum of a volume of the connecting line and a volume of the second rail, minus a volume of the first rail, and multiplied by a factor that is in the range of 0.5 to 1, which in equation form is represented as $V_B=M(V_C+V_2-V_1)$ where: $V_B$=volume of distributor block; $V_1$=volume of first rail; $V_2$=volume of second rail; $V_C$=volume of connecting line; and M=factor between 0.5 and 1.

* * * * *